United States Patent [19]

James, Jr. et al.

[11] Patent Number: 4,594,144

[45] Date of Patent: Jun. 10, 1986

[54] PROCESS FOR MAKING HIGH OCTANE GASOLINE

[75] Inventors: Robert B. James, Jr., Northbrook; Don B. Carson, Mt. Prospect, both of Ill.

[73] Assignee: UOP Inc., Des Plaines, Ill.

[21] Appl. No.: 744,824

[22] Filed: Jun. 14, 1985

[51] Int. Cl.[4] ..... C10G 57/00

[52] U.S. Cl. ..... 208/62; 208/63; 208/65; 208/66

[58] Field of Search ..... 208/62, 63, 65, 66

[56] References Cited

U.S. PATENT DOCUMENTS

| | | | |
|---|---|---|---|
| 3,349,023 | 10/1967 | Paterson | 208/68 |
| 3,351,547 | 11/1967 | Drehman et al. | 208/63 |
| 3,533,938 | 10/1970 | Leas | 208/80 |
| 3,649,520 | 3/1972 | Graven | 208/93 |
| 3,650,943 | 3/1972 | Schuller | 208/60 |
| 3,658,690 | 4/1972 | Graven | 208/62 |
| 3,726,789 | 4/1973 | Kovach | 208/80 |
| 3,756,940 | 9/1973 | Donaldson | 208/66 |
| 3,758,401 | 9/1973 | Bridgeford et al. | 208/62 |
| 3,787,314 | 1/1974 | Donaldson et al. | 208/60 |
| 3,788,975 | 1/1974 | Donaldson | 208/60 |

*Primary Examiner*—Curtis R. Davis

*Attorney, Agent, or Firm*—Thomas K. McBride; John F. Spears, Jr.; Jack H. Hall

[57] ABSTRACT

A process for converting the naphtha fractions distilled from crude oil into greater volumes than heretofore of a gasoline product having higher octane number and a distillate stream of improved cetane number and smoke point by sending the lower boiling naphtha fraction directly to the gasoline pool and subjecting the higher boiling naphtha fraction to a mild reforming treatment, extracting the reformate to separate two streams, aromatics which are directed to the pool and paraffins which are sent to a splitter to separate the paraffin stream into fractions greater than $C_8$ and a $C_8$ or less fraction. The $C_8$ or less fraction is cracked, thermally or catalytically and alkylated and/or polymerized before being directed to the gasoline pool. The fraction from the splitter containing hydrocarbons greater than $C_8$ can be used in the distillate pool.

8 Claims, 2 Drawing Figures

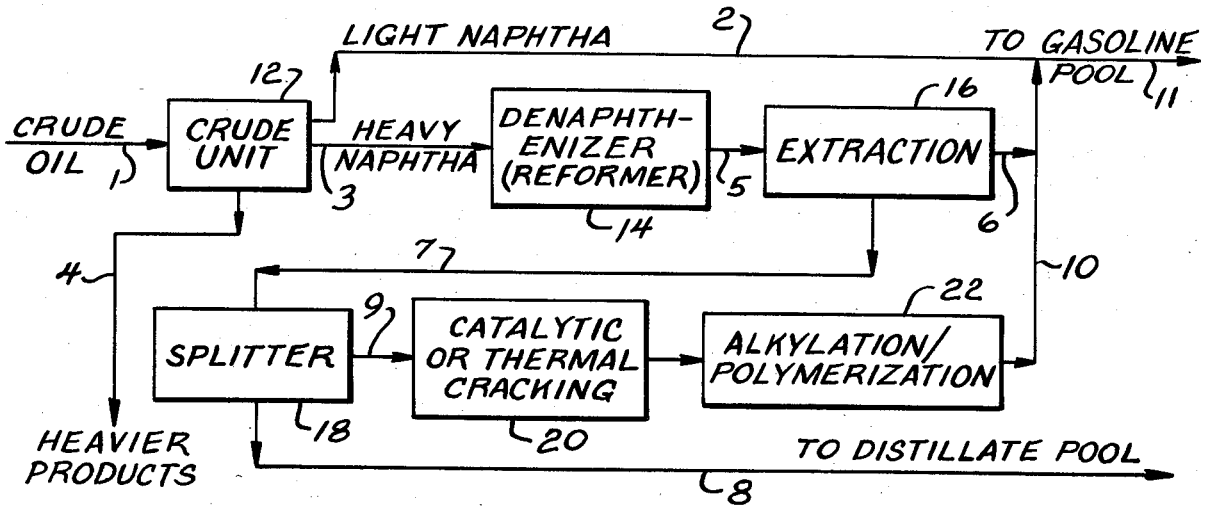
FIG. 1
FIG. 2
(PRIOR ART)
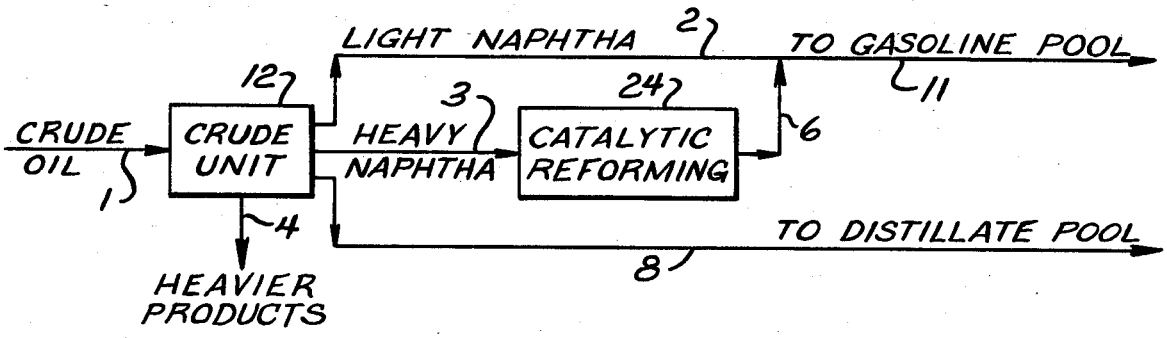

PROCESS FOR MAKING HIGH OCTANE GASOLINE

BACKGROUND OF THE INVENTION

The present invention relates to a combination process for producing high octane gasoline or gasoline blending components and middle distillates for fuels or blending components from a light boiling range hydrocarbon charge stock. There are many prior art processes dealing with methods of upgrading gasoline or converting higher boiling point fractions to obtain high octane gasoline. U.S. Pat. Nos. 3,658,690 and 3,649,520 show traditional processing elements for improving the octane of a gasoline boiling range feedstock via reforming, aromatic separation and isomerization. Other processes for converting straight run gasoline and kerosene boiling fractions into improved octane motor fuels also include catalytic cracking and alkylation steps. U.S. Pat. Nos. 3,787,314 and 3,758,401 are representative of such schemes. However, the major objective of these inventions is the production of gasoline without regard to the yield of other middle products. As indicated by U.S. Pat. Nos. 3,726,789 and 3,756,940, it is typically taught to crack or reform paraffinic components having 7 or more carbon atoms into higher octane isomers or aromatics. The conversion of paraffinic components to higher density aromatics results in a volumetric shrinkage of product. The problem of volumetric shrinkage of paraffin components is addressed in U.S. Pat. Nos. 3,788,975 and 3,650,943. Nevertheless the two referenced patents still teach the combination of refining aromatic extraction and paraffin cracking only in relation to the production of unleaded gasoline. Thus the emphasis of the prior art has been the maximization of octane for gasoline products when processing a naphtha boiling range feed with little attention given to the total liquid product yield.

In regard to middle distillate production the combination of reforming, aromatic extraction, cracking, and alkylation have been used in the production of jet fuels as demonstrated by U.S. Pat. No. 3,533,938. However, these processing steps were arranged to obtain such fuels from heavy hydrocarbon feeds and not to maximize the liquid volume of gasoline and middle distillate product. Of course, methods of increasing the middle distillate to gasoline ratio of products obtained from heavy hydrocarbon feeds as exemplified by U.S. Pat. No. 3,349,023 are known. Nevertheless, such processing schemes do not demonstrate the method of using hydrocarbon components of lighter boiling fractions to optimum advantage.

There is an increasing demand for methods of processing naptha boiling range fractions in a manner which will produce high cetane middle distillates along with high octane gasoline components.

Concentration on increasing octane for gasoline products is of course a direct result of the demand for unleaded gasoline and an increasing market for premium grade unleaded fuel. In a conventional reforming scheme for upgrading octane the $C_7$–$C_{10}$ paraffins are typically converted in part to aromatics and hydrocracked to some extent into lighter gasoline products and fuel gas. However, neither of these reactions takes full yield and octane advantage of the components since the aromatization of the paraffins into higher density components results in a large volumetric shrinkage while the paraffin gasoline constituents are poor in octane number.

The failure to optimize the use of light hydrocarbon components will become less tolerable with the expected increase in the distillate to gasoline ratio for petroleum motor fuel products. Although the automotive diesel market has not risen according to predictions, the decreased gasoline consumption of newer automobiles and the rising demand for jet fuel should still shift the product ratio over to increased distillate production. As a result, it will become desirable to increase total product yield of gasoline and distillate in addition to upgrading the octane number of the gasoline fraction and cetane number of the distillate.

SUMMARY OF THE INVENTION

Accordingly it is an object of the present invention to upgrade the octane rating of a gasoline product obtained from a naphtha boiling hydrocarbon fraction. It is a further objective of this invention to increase yields of middle distillate products when processing lighter boiling feeds. An additional objective is to obtain a middle distillate having an improved cetane number. These and other objectives are obtained by the process of the invention wherein a light hydrocarbon fraction is separated into lower and higher boiling point streams with the higher boiling stream undergoing reforming and extraction of aromatics so that the aromatics are blended with the lower boiling gasoline product stream and the paraffin containing raffinate is further separated into lighter components, which after cracking and alkylation or polymerization are also blended with the gasoline product, and heavier components which are used in furnishing a middle distillate product or blending components. In effecting the process the lower boiling point stream will contain hydrocarbons boiling at and below the range of normal hexane. The higher boiling stream comprises aromatics, naphthenes and paraffins boiling above normal hexane to about 440° F. The hereinafter described reforming process is operated primarily to convert naphthenes to aromatics which are then separated from the paraffins via the later described extraction process. In order to obtain maximum benefit from the remaining paraffins a relatively light paraffin stream comprising $C_7$ and $C_8$ components is split from the heavier components and processed to obtain higher octane gasoline components by cracking and alkylation or polymerization. The remaining heavier components, now essentially free of aromatics, are available as an improved source of jet fuel, kerosene and diesel products or blending components.

Thus by the herein described arrangement of separation zones and selection of processing zones the multistage process of this invention will provide a high volume of liquid products while simultaneously upgrading the quality of middle distillate and gasoline products.

Therefore, in a broad embodiment the present invention involves a process for the simultaneous production of straight run gasoline fraction, an aromatic concentrate, a high octane alkylate stream and a middle distillate product stream from a naphtha boiling range feed stream which process comprises the steps of (a) separating the feed into a straight run gasoline stream essentially free of $C_7$ paraffins and higher boiling hydrocarbons and a higher boiling stream essentially free of $C_6$ paraffins and lower boiling hydrocarbons; (b) reacting the higher boiling stream in a reforming zone at reforming conditions selected to convert naphthenic hydrocarbons to aromatic hydrocarbons; (c) separating the resulting reforming effluent to recover an aromatic concentrate and a stream rich in $C_7$ and higher paraffins; (d) separating the paraffin rich stream to recover relatively light paraffin stream comprising $C_8$ paraffins and lower boiling hydrocarbons; and a middle distillate product stream comprising $C_9$ and higher boiling hydrocarbons; (e) converting at least a portion of the lighter paraffin stream into gasoline components comprising high octane alkylates; and (f) combining at least a portion of the converted paraffin stream with the aromatic concentrate and straight run gasoline to obtain a high octane gasoline product stream.

In a particularly preferred embodiment the present invention is a multistage process for simultaneously obtaining high octane gasoline and a large middle distillate yield from a crude oil fraction having an initial boiling point in the range of normal hexane and an end boiling point of about 400° F. which process comprises the steps (a) separating the crude oil fraction into a straight run gasoline stream having an end boiling of 170° F. and a higher boiling fraction having an initial boiling point of 170° F. and an end boiling point of about 400° F.; (b) reacting the higher boiling fraction in a reforming zone selected to selectively convert cyclic aliphatic hydrocarbons having six to eleven carbon atoms into aromatic hydrocarbons while minimizing hydrocracking reactions; (c) passing the reforming zone effluent into a solvent extraction zone to recover a first gasoline blending stream comprising an aromatic concentrate and a stream comprising $C_7$–$C_{11}$ paraffins; (d) splitting said paraffin containing stream into a first stream comprising $C_7$–$C_8$ paraffins and a second middle distillate product stream comprising $C_9$–$C_{11}$ paraffins; (e) charging said $C_7$–$C_8$ paraffin stream into thermal or catalytic cracking zone to obtain saturated and unsaturated hydrocarbons of reduced size; (f) passing at least a portion of the effluent from the cracking zone through alkylation or polymerization zones to obtain a second stream of gasoline blending components comprising branched chain paraffins; and (f) combining at least a portion of the first and second gasoline blending component streams with a portion of the straight run gasoline stream to obtain a high octane gasoline product stream.

Other embodiments of this invention involve the use of different separation schemes and additional recycle streams as well as various operating conditions, catalyst compositions and processing units. These other embodiments are discussed in the detailed description of this invention.

BRIEF DESCRIPTION OF THE DRAWINGS

FIG. 1 is a block flow diagram showing a preferred embodiment of the herein disclosed process for upgrading gasoline while maximizing liquid product recovery.

FIG. 2 is offered for the value of comparison and demonstrates a conventional method of treating a light crude oil fraction to obtain gasoline and middle distillates.

DETAILED DESCRIPTION OF INVENTION

The naphtha boiling range charge used in this invention can be derived from a number of sources. One source constitutes naphtha distillates which are derived from a full boiling point range crude oil. In addition other possible sources include hydrocarbon fractions obtained from the reaction of gas oils or other heavy hydrocarbons in fluid catalytic cracking or hydrocracking zones. Regardless of its source an appropriate hydrocarbon fraction for this invention should contain substantial amounts of paraffinic, naphthenic and aromatic components so that liquid volume yields of gasoline and middle distillates can be maximized and the treatment zones can be used in a beneficial manner. A highly preferred feed will contain between 40 to 80 wt. % paraffins, 10 to 30 wt. % naphthenes and 10 to 30 wt. % aromatics.

In view of the fact that many of the possible sources of the desired hydrocarbon fraction may contain sulfurous or nitrogenous contaminants, pretreatment of the charge stock for removal of these compounds is contemplated. However, such pretreatment methods are well known in the art and do not form an essential part of this invention.

In the first stage of applicants' invention the charge stock boiling in the range of normal pentane to about 400° F. is further separated into lower and higher boiling point streams at a cut point of about 170° F. As shown in FIG. 1 the charge stock having the desired boiling point range is conveniently withdrawn from a crude unit wherein the $C_4$ and lighter ($C_4$ minus) hydrocarbons are normally removed as an overhead stream and a 400° F. to 440° F. cut point for the upper boiling point of the charge is readily established.

Other fractionation facilities can also be used to obtain a charge stock of the desired boiling range from the previously discussed sources of suitable charge stocks. Furthermore the initial separation of the charge stock into lighter and heavier components will typically be performed in the fractionation facilities from which the charge stock is obtained, but could be accomplished in an additional separation zone.

The cut point for the lower and higher boiling streams is kept at about 170° F. in order to remove $C_6$ aromatics from other $C_6$ and lower boiling hydrocarbons. When gasoline octane requirements demand it is also possible to effect a further separation of the lighter boiling stream for the removal of normal hexane and similar boiling point compounds which are subsequently treated in the hereinafter described cracking and alkylation/polymerization zone to obtain additional high octane alkylate. In regard to the upper boiling point of the higher boiling stream, this separation temperature improves the quality of the remaining middle distillates in the charge stock by removing additional aromatics. Apart from the separations discussed herein, the design of fractionation facilities for performing the described separations are well known and will not be discussed in detail.

The lower boiling stream from the initial separation of the charge stock comprises a natural gasoline. This stream will typically contain $C_5$ and $C_6$ paraffins, having an unleaded Research method octane number within a range of about 40 to 60. As mentioned earlier, there may be an additional separation of the essentially straight chain or monomethyl $C_6$ alkanes, the removal of which will raise the octane number of the straight run gasoline fraction. Separation of these normal hexane boiling range components is possible by any well known means of fractionation or by selective sorption. The straight run gasoline fraction with or without the separation of $C_6$ paraffins is combined with the hereinafter decribed blending components to yield a gasoline product having an unleaded Research method octane rating of between 85 and 100.

The higher boiling hydrocarbon stream after separation from the charge stock is first transferred to a reforming zone. Components of this stream include paraffins, naphthenes and aromatics having a boiling point at or above that of benzene. The reforming zone can consist of any commonly known multireaction zone systems employing two or more reaction zones through which continuously regenerated catalyst is passed or fixed beds of catalyst are maintained.

Catalytic composites, suitable for utilization in the reforming reaction zone, generally comprise a refractory inorganic oxide carrier material containing a metallic component selected from the noble metals of Group VIII. Activity and stability are also significantly enhanced through the addition of various catalytic modifiers, especially tin, rhenium, nickel and/or germanium, thereby forming multi-metallic catalysts. Suitable porous carrier materials include refractory inorganic oxides such as alumina, silica, zirconia, etc. Generally favored metallic components include ruthenium, rhodium, palladium, osmium, rhenium, platinum, iridium, germanium, nickel and tin, and mixtures thereof. These metallic components are employed in concentrations ranging from about 0.01 percent to about 5.0 percent by weight, and preferably from about 0.01 percent to about 2.0 percent by weight. Reforming catalysts may also contain combined halogen selected from the group of chlorine, fluorine, bromine, iodine and mixtures thereof, with chlorine and fluorine being particularly preferred.

In accordance with this invention the reforming zone is operated primarily to convert $C_7$ and higher naphthenes to aromatics. An operation of this type is characterized by low severity operation. Low severity operation is well known to increase catalyst life while allowing more throughput, and to decrease the production of ethane and methane. Typical reforming conditions include catalyst temperatures in a range of 800° F. to 1100° F., pressures of 3 atmospheres to 70 atmospheres, and a liquid hourly space velocity (LHSV) (volume of oil per hour per volume of catalyst) of from 1.0 to 5.0 $hr.^{-1}$. In addition, hydrogen typically in the form of a recycle gas is combined with the incoming charge at a ratio of about 1.0 to 20.0 moles of hydrogen per mole of hydrocarbon. The low severity reforming zone of this invention will preferably employ the following operating conditions: a temperature of 750° F. to 950° F.; a pressure of 3 to 30 atmospheres; a LHSV of 1.0 to 3.0; and a hydrogen recycle in the range of 1.0 to 6.0 moles of hydrogen per mole of hydrocarbon. Effluent from the reforming zone will contain relatively few naphthenic compounds. The major constituents of the effluent will be aromatics, paraffins with some $C_4$, lighter components which are removed from the process and less than 10 weight percent naphthenes. The reforming zone effluent is then transferred to an aromatic separation zone.

Separation of aromatics can be effected in any known manner, including crystallization, fractionation and selective adsorption. A particularly preferred method of separating the aromatics is solvent extraction. Solvent extraction processes are well known in the art. Typical examples of these processes are illustrated in U.S. Pat. Nos. 3,864,245, 3,361,664 and 2,773,918. The basic concept behind solvent extraction processes is the use of solvent in which the aromatic components of the reformed stream are more soluble than paraffinic components. In operation the extraction method will usually include liquid-liquid extraction and extractive distillation. There are a wide variety of normally liquid and generally polar organic compounds which possess the necessary selectivity. Appropriate solvents have a boiling point above the boiling point of the hydrocarbon mixture at an ambient extraction pressure. Any of the numerous organic solvents which are well known in the art may be employed in this invention. A particularly preferred class of solvents are the sulfolane derivatives. U.S. Pat. No. 3,992,222 sets forth numerous sulfolane type solvents. It is also known that the selectivity of the solvents for aromatic hydrocarbons may be improved by the addition of water. Depending on the process conditions of the extraction zones, the solvent may contain from about 0.5 to about 20.0 percent water by weight.

Operating conditions for solvent extaction are selected to keep the solvent in liquid phase. Operating temperatures normally range from about 80° F. to about 400° F. with pressures running from atmospheric to about 400 psig.

After passage through the extraction zone, essentially all of the aromatics have been removed from the reformate stream. The condensed aromatic stream is then blended in whole or in part with the straight run gasoline stream. To the extent that the aromatic conentrate is not needed for octane requirements, it may serve as a separate product stream or chemical feedstock.

Raffinate from the extraction zone comprising primarily $C_7$ and higher paraffins enter a splitter. The splitter employs well known fractionation techniques to separate the raffinate into a lighter paraffin stream composed of hydrocarbons boiling at or below the boiling point of normal octane and a heavier paraffin stream comprising $C_9$ and heavier ($C_9$ plus) hydrocarbons.

The $C_9$ plus stream is recovered as middle distillate product or blending component. In relation to the starting components of the charge stock a high yield of middle distillates is obtained from the splitter via the heavy hydrocarbon stream. By controlling the separation and processing of the various light hydrocarbon components, this flow scheme avoids cracking of the $C_9$ and higher paraffins so that these components are used to maximum advantage in producing a high liquid product yield. Moreover, the invention also redirects highly alkylated aromatics from middle distillate product streams into gasoline blending components thereby simultaneously improving the quality of the middle distillate product. These middle distillates may be advantageously blended with other middle distillates that are recovered from the crude unit or other fractionation facility from which the charge stock is obtained.

The other component of the extract raffinate stream containing $C_8$ minus hydrocarbons is further processed in a paraffin upgrading zone to raise the octane level of these components. Such processing consists of first cracking the components into lighter hydrocarbons and then rearranging the smaller molecules into higher octane components via alkylation or polymerization. Although the complexity of the section for processing the lighter paraffin stream may vary, it will contain at least a cracking unit and an alkylation or polymerization unit.

Cracking of the $C_8$ minus catalyst stream is accomplished using either thermal or catalytic cracking. Regardless of the type, the cracking zone must be capable of cracking the $C_7$ through $C_8$, and optionally $C_6$, saturated hydrocarbons to lower molecular weight hydrocarbons, with production of dry gases such as ethane, ethylene, or acetylene being minimized, while production of propane, propylene, butanes, butylenes, and cracked gasoline is maximized.

Operations in the catalytic cracking zone require elevated temperatures and controlled catalyst contact times. Reaction temperatures in the range of about 850° F. to 1400° F. are preferred. Pressures in this type of operation are usually low and range from 1 to about 10 atmospheres. In order to insure production of a large quantity of propylene and butylene careful control of the contact time between the catalyst and cracking zone feed is essential. In a fixed bed cracking process in which the feed is typically processed in a once through operation, the amount of olefinic hydrocarbon production will increase in relation to decreased space velocity. Looking at fluidized catalytic cracking operations, space velocity is usually defined in terms of weight hourly space velocity, which means weight of the charge per hour per weight of catalyst within the reaction zone. A weight hourly space velocity greater than 0.04 is usually preferred with an upper limit of about 0.2.

Cracking of the saturated hydrocarbon stream demands proper catalyst selection. Well known catalysts for use in these processes include amorphous silica-alumina and zeolitic aluminosilicates. Thus, cracking catalysts suitable for use in the saturate cracking zone include silica-alumina, silica-magnesia, silica-zirconia and various crystalline aluminosilicates which are characterized as having high cracking activities. The preferred crystalline aluminosilicate cracking catalyst can be used in admixture with the less active amorphous type, or can be present in substantially pure form. The crystalline aluminosilicate may be naturally-occurring or synthetically prepared. Whether the catalyst comprises a crystalline aluminosilicate, or an amorphous material, selected metals may be combined therewith by way of ion-exchange or impregnation. Such combined metals include the rare earth metals and alkaline metals, alkaline-earth metals, Group VIII metals, Group V-B metals, etc. Suitable schemes for effecting the cracking of the saturated liquid stream from the catalytic reforming reaction zone are illustrated in U.S. Pat. Nos. 3,161,583 and 3,206,393 although specifically directed toward heavier charge stocks. It is contemplated that the cracking operation of this invention may either take place in an existing cracking zone used simultaneously to crack heavier charge stocks, or in a separate zone with conditions selected to maximize the desired reactions.

While catalytic cracking is preferred, The $C_8$ minus stream of saturates may be thermally cracked. However, thermal cracking will produce larger quantities of lighter hydrocarbons. In addition, thermal cracking process conditions usually include higher temperatures and pressures, with temperatures ranging from 900° F. to 1500° F. and pressures of from atmospheric to 35 atmospheres.

Effluent from the cracking zone will contain a full range of saturated and unsaturated $C_1$ to $C_8$ hydrocarbons. Initial separation of the cracked product will be performed with light gases such as methane and ethane being removed from the process while $C_6$ or $C_7$ and higher hydrocarbons may be returned to the cracking zone. The remaining middle range products such as propane, propylene, normal and isobutane, normal and isobutene, and pentenes enter the alkylation or polymerization zone wherein these products are reacted to produce higher octane components. It is also possible to recover $C_5$ components from the cracking operation and add these directly to the straight run gasoline stream.

Combination of the retained cracked components from the cracking operations is accomplished using alkylation or polymerization to convert these short chained hydrocarbons into higher branched molecules having a higher octane rating. Alkylation or polymerization may be used alone or in combination. In some cases it may also be beneficial to include an isomerization zone in order to provide additional branched chain components.

The alkylation zone of this invention may be any acidic catalyst reaction system such as a hydrogen fluoride-catalyzed system, or one which utilizes a boron halide in a fixed-bed reaction system. Hydrogen fluoride alkylation is particularly preferred, and may be conducted substantially as set forth in U.S. Pat. No. 3,249,650. Briefly, the alkylation reaction when conducted in the presence of hydrogen fluoride catalyst, is such that the catalyst to hydrocarbon volume ratio within the alkylation reaction zone is from about 0.5 to about 2.5. Ordinarily, anhydrous hydrogen fluoride will be charged to the alkylation system as fresh catalyst; however, it is possible to utilize hydrogen fluoride containing as much as 10.0% water or more. Excessive dilution with water is generally to be avoided since it tends to reduce the alkylating activity of the catalyst and further introduces corrosion problems. In order to reduce the tendency of the olefinic portion of the charge stock to undergo polymerization prior to alkylation, the molar proportion of isoparaffins to olefinic hydrocarbons in an alkylation reactor is desirably maintained at a value greater than 1.0, and preferably from about 3.0 to about 15.0. Alkylation reaction conditions, as catalyzed by hydrogen fluoride, include a temperature of from 0° to about 200° F., and preferably from about 30° F. to about 125° F. The pressure maintained within the alkylation system is ordinarily at a level sufficient to maintain the hydrocarbons and catalyst in a substantially liquid phase; that is, from about atmospheric to about 40 atmospheres. The contact time within the alkylation reaction zone is conveniently expressed in terms of space-time, being defined as the volume of catalyst within the reactor contact zone divided by the volume rate per minute of hydrocarbon reactants charged to the zone. Usually the space-time will be less than 30 minutes and preferably less than about 15 minutes.

Provided there is sufficient isobutane to react with the quantity of olefins produced in the cracking zone the alkylation zone will be useful in converting the $C_3$ and $C_4$ olefins into high octane alkylates. Of course, it is likely that olefin production from the cracking zone will greatly exceed the isobutane yield. As a result, a polymerization unit may be added to catalytically polymerize olefins into polymers having 2–3 monomer units which will also yield a gasoline product, or an isomerization unit added into the paraffin upgrading section to increase the quantity of isobutane reactant for the alkylation step. It is also possible to incorporate isomerization in conjunction with a polymerization unit. As taught in U.S. Pat. No. 4,339,113, the addition of the isomerization unit will also allow the double bonds of the butene components to be rearranged, thereby increasing the octane number of the alkylation products. Schemes for utilizing alkylation, isomerization, and polymerization to increase the octane number of short chain olefins and paraffins are well known in the art.

In any event, the polymerization process of this invention is used to polymerize olefins. Such processes are well known in the art and are generally disclosed by U.S. Pat. Nos. 2,596,497 and 2,909,580. As used herein polymerization also refers to the co-polymerization of a mixed olefin stream. Polymerization reactions are generally effected in the presence of a catalyst and at temperatures from 70° F. to 750° F. and pressures of from 10 to 100 atmospheres. Any liquid or solid catalyst known to initiate the olefin combination may be used in the polymerization unit. Commercial units commonly use a solid phosphoric acid catalyst taught in U.S. Pat. No. 1,993,513. However, the use of a solid phosphoric acid catalyst, further details of which can be found in U.S. Pat. Nos. 3,050,472, 3,050,473, 3,132,109 and 3,402,130, is preferred.

When a polymerization zone is incorporated, the preferred products of the reaction are $C_6$ to $C_{12}$ olefins. These components will ultimately be combined with the natural gasoline fraction while unreacted olefins and heavy polymers having 3 or more monomer units can be recycled, respectively, back to the polymerization unit or the cracking section.

As previously stated, it may be beneficial to include an isomerization zone in the paraffin upgrading section. The isomerization zone may be used to rearrange bonds in butenes in order to obtain more valuable gasoline products, but is primarily used to increase the supply of isobutane to the alkylation unit. Accordingly, the typical charge to the isomerization unit will consist of a n-butane concentrate.

As indicated in U.S. Pat. No. 2,900,425, the isomerization process is effected in a fixed-bed system utilizing a catalytic composite of a refractory inorganic oxide carrier material, a Group VIII noble metal component and a metal halide of the Friedel-Crafts type. As previously indicated, the refractory oxide carrier material may be selected from the group of metallic oxides including alumina, silica, titania, zirconia, alumina-boria, silica-zirconia, and various naturally-occurring refractory oxides. Of these, a synthetically-prepared gamma alumina is preferred. The Group VIII noble metal is generally present in an amount of about 0.01% to about 2.0% by weight, and may be one or more metals selected from the group of ruthenium, rhodium, osmium, iridium, and particularly platinum or palladium. Suitable metal halides of the Friedel-Crafts type include aluminum chloride, aluminum bromide, ferric chloride, ferric bromide, zinc chloride, beryllium chloride, gallium chloride, titanium tetrachloride, zirconium chloride, stannic chloride, etc. The quantity of the Friedel-Crafts metal halide will be within the range of about 2.0% to about 25.0% by weight.

The isomerization reaction is preferably effected in a hydrogen atmosphere utilizing sufficient hydrogen so that the hydrogen to hydrocarbon mole ratio of the reaction zone feed will be within the range of from about 0.25 to about 10.0. Operating conditions will further include temperatures ranging from about 200° F. to about 650° F. although temperatures within the more limited range of about 300° F. to about 600° F. will generally be utilized. The pressure under which the reaction zone is maintained will range from about 3 atmospheres to about 10 atmospheres. A fixed-bed type process is preferred, with the butane and hydrogen feed passing through the catalyst in downward flow. The reaction products are separated from the hydrogen, which is recycled, and subjected to fractionation and separation to produce the desired reaction product. Recovered starting mateial is also recycled so that the overall process yield is high. Liquid hourly space velocites will be maintained within the range of about 0.25 to about 10.0, and preferably within the range of about 0.5 to about 5.0. Another suitable isomerization process, for the production of isobutane, is found in U.S. Pat. No. 2,924,628.

The following examples are provided to give a more complete understanding of this invention in the context of a particular embodiment. The flow diagram illustrating the invention is shown in FIG. 1 and referred to in Example 1. Details of pumps, compressors, instruments and other process equipment are not included in the figure, but will be readily understood by persons skilled in the art. In addition, the detailed discussion of the particular embodiment shown in FIG. 1 is not meant to limit the invention to the particular process arrangement of this example. FIG. 2 illustrates conventional practice described in Example 2. Reference numbers and flow stream designations referred to in the examples are as set forth in the figures.

EXAMPLE 1

In this example, it is assumed that 100,000 barrels per day of a light Arabian crude oil blend enters a crude fractionation unit 12. This stream is shown as stream 1 in FIG. 1. The light naphtha produced from the crude unit, shown as stream 2, consisting of hydrocarbons boiling below about 170° F., consists of normal hexane and lower boiling components. A heavy naphtha stream shown as stream 3 is withdrawn from the crude unit 12. This heavy naphtha stream consists of hydrocarbons from heptane boiling range to about 400° F. boiling point. Particularly, we wish to include in the heavy naphtha stream all aromatic hydrocarbons present in the crude oil whose boiling point would permit their inclusion into the final gasoline blend and to further include in the heavy naphtha stream all naphthenes which when converted to the corresponding aromatic hydrocarbons would be of suitable boiling range for inclusion in the fnal gasoline blend. Additional streams, shown as a third stream 4, are also withdrawn from crude unit 12, containing all hydrocarbons having a boiling point higher than 400° F.

The heavy naphtha, after suitable pretreatment, such as desulfurization, not shown, but well known to those skilled in the art, is processed in a denaphthenizer 14. The denaphthenizer 14 is essentially a catalytic reformer, but with catalyst and operating conditions tailored to encourage the conversion of naphthenes to aromatics while minimizing the hydrocracking reactions.

The product from the denaphthenizer 14, after removal of such gases as hydrogen, methane, ethane, propane, butanes, etc. will consist largely of paraffins and aromatics, and is shown as stream 5. Stream 5 is processed in a separations unit, in this case, a solvent extraction unit 16. The extraction unit 16 produces a concentrated stream of aromatics 6 and a concentrated stream of paraffins 7. Stream 6 is an excellent high octane number stock which is routed to the gasoline pool stream 11 for final blending. Stream 7 consists predominately of paraffinic hydrocarbons in the boiling range of heptanes through 400° F. The heptane and octane paraffins in stream 7 have an octane rating too low for inclusion in the gasoline pool and a boiling point so low that they are not suitable for inclusion in the distillate pool.

Consequently, stream 7 is processed in a fractionator, or splitter 18, to separate the heptane and octane paraffins from the higher boiling paraffins. The higher boiling paraffins are withdrawn from the fractionator as stream 8 and routed to the distillate pool for final blending.

The heptane and octane paraffins are withdrawn from the fractionator as stream 9. This stream has unique properties which enhance its value for such uses as solvents, pyrolysis feed, etc. Thus, in some instances where a ready market exists, stream 9 may be a final product. For the purposes of this example, it is assumed that no such market exists, and that the refiner wishes to further process stream 9 into a high quality gasoline pool component. Therefore, stream 9 is catalytically or thermally cracked in cracking unit 20, and converted largely into propane, propylene, butanes and butylenes. These cracked components are further processed in conventional alkylation and/or polymerization units 22 into alkylate and/or polymer, resulting in stream 10. Stream 10 is a high octane number gasoline blending component, and is directed to the gasoline pool stream 11. The calculated yields of the various streams are shown in the table following Example 2, referring to the numbered streams.

EXAMPLE 2

Conventional refinery processing for the same portion of the 100,000 barrels per day of light Arabian crude is illustrated in this example and processing steps are shown graphically in FIG. 2. The fractionation cut points in the crude unit differ from those of the operation shown in FIG. 1 as will be explained below. Where similar streams exist in the process illustrated by FIG. 2 and that of Example 1, the same numbers have been assigned, for ease in comparison.

The light naphtha produced from the crude unit 12 in conventional operation, stream 2 in FIG. 2, will consist of hydrocarbons boiling below about 200° F. Were this operation to be altered to produce a 170° F. endpoint light naphtha, the difficulty of producing a high octane rating gasoline from the 170°–400° F. cut fed to the catalytic reforming unit would be increased, and the volumetric yield loss during this processing would be greater. This is because the hydrocarbons in the 170° F. to 200° F. boiling range are lean in aromatics and in naphthenes, and substantial hydrocracking must be performed to convert the low octane number paraffins.

The heavy naphtha stream 3 withdrawn from the crude unit will consist of hydrocarbons in the boiling range of approximately 200° F. to 350° F. and is directed to a catalytic reformer 24. The upper boiling range limit of about 400° F., utilized in the processing sequence of FIG. 1, is not selected for conventional processing because of the refiner's need for front end volatility in his ultimate distillate products, and because inclusion of the paraffinic hydrocarbons in the 350° F. to 400° F. boiling range would result in poor yield. The bottom stream 4 is similar to that of Example 1. The reformate stream 6 contains primarily paraffins and aromatics and is directed to the gasoline pool stream 11.

Referring again to FIG. 2, the 350° F. to 400° F. boiling range material is directed to the distillate blending pool stream 8. Other higher boiling hydrocarbons are sometimes separated for inclusion in the distillate pool rather than being included in the fraction labelled heavier products.

The following is a tabulation of the liquid product yields and qualities which are derived from the 400° F. endpoint material originally present in a typical crude oil, when utilizing the processing scheme of Example 1 compared to that of Example 2:

| | Example 1 | Example 2 (Conventional) Processing |
|---|---|---|
| Stream 1 - Crude Unit Charge, B/D | 100,000 | 100,000 |
| Stream 2 - Light Naphtha, B/D | 7,132 | 9,270 |
| Endpoint, °F. | 170 | 200 |
| Research Octane, Unleaded | 61.3 | 56.3 |
| Stream 6 - Reformed Gasoline, B/D | 6,958 | 12,740 |
| Research Octane, Unleaded | 109 | 95 |
| Stream 10 - Alkylate Polymer, B/D | 4,163 | 0 |
| Research Octane, Unleaded | 92 | — |
| Stream 11 - Total to Gasoline Pool, | 18,253 | 22,010 |
| B/D Research Octane, Unleaded | 86.5 | 78.7 |
| Stream 8 - Total to Distillate Pool, | 8,857 | 3,710 |
| B/D Aromatics, % L.V. | 1 | 22.5 |
| Total Liquid Products, B/D | 27,110 | 25,720 |

It is apparent from the above tabulation that the processing scheme of this invention not only results in a larger volume of total liquid products, but also results in improved quality of both the gasoline blending stream and the distillate blending stream.

With regard to the gasoline blending pool, it is not possible for the scheme of FIG. 2 to match that of FIG. 1 in octane number of gasoline product. For example, if the severity of the reforming step of Example 2 were raised from 95 to 100 research octane unleaded, it would raise the octane level of the total stream 11 to gasoline blending from 78.1 to about 80.1 octane number, but the quantity of this total stream would be sharply reduced from 22,010 B/D to 20,380 B/D.

With regard to the distillate blending pool, the presence of aromatics in distillate products is undesirable both from the standpoint of cetane number and smoke point. The lower aromatics content of the distillate pool stream 8 yielded by the flow scheme of FIG. 1, hence its quality, simply cannot be matched by the flow scheme of FIG. 2.

We claim as our invention:

1. A process for simultaneously raising the octane number of a gasoline product stream and improving the cetane number and smoke point of a distillate stream, while increasing the total volume of liquid products obtained from a naphtha boiling range charge stock which process comprises the steps of:

(a) separating said charge into a natural gasoline stream comprising a lower boiling point stream essentially free of $C_7$ paraffins and higher boiling hydrocarbons, and a higher boiling point stream essentially free of $C_6$ paraffins and lower boiling hydrocarbons;

(b) reacting said higher boiling stream in a reforming reaction zone, at reforming conditions and with a reforming catalyst selected to convert naphthenic hydrocarbons to aromatic hydrocarbons;

(c) separating the resulting reforming effluent stream to recover an aromatic concentrate and a stream rich in $C_7$ and higher paraffins;

(d) separating said paraffin rich stream to recover a light paraffin stream comprising $C_8$ paraffins and lower boiling hydrocarbons and a middle distillate product stream comprising $C_9$ and higher boiling hydrocarbons;

(e) converting at least a portion of the lighter paraffin stream into a high octane gasoline component in a paraffin upgrading zone;

(f) combining at least a portion of the converted light paraffin stream and the aromatic concentrate with the natural gasoline stream to recover a high octane gasoline product stream.

2. The process of claim 1 further characterized in that said lower boiling point stream has an end boiling point of about 170° F. and said higher boiling point stream has an initial boiling point of about 170° F. and a maximum end boiling point of about 440° F.

3. The process of claim 1 further characterized in that said reforming effluent stream is separated in a solvent extraction zone.

4. The process of claim 1 further characterized in that the reforming zone conditions include a temperature in the range of from 950° F. to 750° F., a liquid hourly space velocity of 1.0 to 5.0, a hydrogen to hydrocarbon ratio of 2.0 to 10.0 mole of hydrogen to mole of hydrocarbon, and a pressure in the range of 450 psig to 50 psig.

5. The process of claim 1 further characterized in that the reforming catalyst comprises a Group VIII multimetallic catalyst.

6. The process of claim 1 further characterized in that the natural gasoline fraction undergoes additional separation to remove a low octane component comprising straight chain or monomethyl $C_6$ alkanes which is charged to said paraffin upgrading zone.

7. The process of claim 1 characterized in that said reforming product is separated by selective adsorption.

8. The process of claim 1 wherein said paraffin upgrading zone contains an alkylation zone, an isomerization zone and a polymerization zone.

* * * * *